US011083933B1

(12) United States Patent
Wilder

(10) Patent No.: US 11,083,933 B1
(45) Date of Patent: Aug. 10, 2021

(54) CHIN-UP/PULL-UP EXERCISE APPARATUS

(71) Applicant: Bryant Wilder, Austin, TX (US)

(72) Inventor: Bryant Wilder, Austin, TX (US)

( * ) Notice: Subject to any disclaimer, the term of this patent is extended or adjusted under 35 U.S.C. 154(b) by 0 days.

(21) Appl. No.: 16/749,564

(22) Filed: Jan. 22, 2020

(51) Int. Cl.

| | |
|---|---|
| ***A63B 23/12*** | (2006.01) |
| ***A63B 21/00*** | (2006.01) |
| ***A63B 21/068*** | (2006.01) |
| ***A63B 1/00*** | (2006.01) |

(52) U.S. Cl.
CPC ..... *A63B 23/1218* (2013.01); *A63B 1/00* (2013.01); *A63B 21/00181* (2013.01); *A63B 21/068* (2013.01); *A63B 21/4035* (2015.10)

(58) Field of Classification Search
CPC ... A63B 23/1218; A63B 1/00; A63B 21/4035; A63B 21/00181; A63B 21/068
See application file for complete search history.

(56) References Cited

U.S. PATENT DOCUMENTS 3,874,657 A * 4/1975 Niebojewski ..... A63B 22/0002 482/104
4,111,414 A * 9/1978 Roberts ..... A63B 1/00 482/102
4,431,184 A * 2/1984 Lew ..... A63B 7/00 482/102
4,619,453 A * 10/1986 Plumridge ..... A63B 21/0605 482/102
4,974,836 A * 12/1990 Hirsch ..... A63B 21/06 473/451
5,050,869 A * 9/1991 Frate ..... A63B 21/154 482/94
5,372,556 A * 12/1994 Ropp ..... A63B 21/0615 482/133
5,403,253 A * 4/1995 Gaylord ..... A63B 21/068 482/140
5,423,730 A * 6/1995 Hirsch ..... A63B 21/06 482/904
5,588,940 A * 12/1996 Price ..... A63B 21/065 224/259
7,621,847 B2 * 11/2009 Lamle ..... A63B 21/00181 482/39
7,867,144 B2 * 1/2011 Quinn ..... A63B 21/0626 482/41
2002/0084139 A1 * 7/2002 Richard ..... A62B 1/14 182/5
2007/0161469 A1 * 7/2007 Lamle ..... A63B 23/03533 482/94
2009/0258761 A1 * 10/2009 Quinn ..... A63B 21/00181 482/41

(Continued)

*Primary Examiner* — Andrew S Lo
(74) *Attorney, Agent, or Firm* — Antony P. Ng; Russell Ng PLLC

(57) ABSTRACT

A chin-up/pull-up exercise apparatus is disclosed. The exercise apparatus includes a frame, an overhead assist module, and a chin bar. The overhead assist module includes a set of pulleys, a harness, and a counter-weight. The set of pulleys is connected to a first vertical location of the frame. The counter-weight is connected to the harness via a cable traveling on the set of pulleys. The chin bar is connected to a second vertical location of the frame. The exercise machine enables real, full arm extension pull ups regardless of one's upper body strength with applications for physical therapy; physical exercise training; muscle, tendon, and joint rehabilitation; and upper and lower body strength building.

6 Claims, 5 Drawing Sheets

(56) References Cited

U.S. PATENT DOCUMENTS

| | | | | |
|---|---|---|---|---|
| 2016/0354669 | A1* | 12/2016 | Rozenberg | A63B 71/0054 |
| 2018/0021623 | A1* | 1/2018 | Brendle | A63B 71/0054<br>482/38 |
| 2019/0224524 | A1* | 7/2019 | Saadallah | A63B 21/078 |

* cited by examiner

CHIN-UP/PULL-UP EXERCISE APPARATUS

PRIORITY CLAIM

The present application claims priority under 35 U.S.C. § 119(e)(1) to provisional application No. 62/899,069 filed on Sep. 11, 2019, the contents of which are incorporated herein by reference.

TECHNICAL FIELD

The present invention relates to exercise apparatuses in general, and in particular to a chin-up/pull-up exercise apparatus.

BACKGROUND

Chin-ups, pull-ups, dips and deep knee bends are well-known upper body and lower body strength training exercises. During a chin-up exercise, a person grasps an overhead bar with his/her palms facing towards his/her face and raises his/her body up to where the chin is above the overhead bar. A pull-up exercise is similar to a chin-up exercise except the palms are facing away from the face. For a dip exercise, a person supports his/her hanging body on a pair of parallel handles with his/her arms, bends his/her arms at the elbow to lower his/her body, and then pushes his/her body straight up by straightening his/her arms.

Chin-up, pull-up and dip exercises are relatively difficult to do because they require a certain amount of strength. People with weak upper body strength may not be able to do any chin-ups, pull-ups or dips. Even those people that do have sufficient upper body strength may only be able to do a few repetitions.

Various devices have been available for assisting people to do chin-up, pull-up and dip exercises. However, the prior art devices tend to be overly complicated and/or difficult to use, and their design limitations do not provide means to assist pulling the user's chin above the overhead bar.

Consequently, it would be desirable to provide an improved exercise apparatus for assisting people to do chin-ups, pull-ups, and/or dip exercises.

SUMMARY

In accordance with a preferred embodiment of the present invention, an exercise apparatus includes a frame, an overhead assist module, and a chin bar. The overhead assist module includes a set of pulleys, a harness, and a counter-weight. The set of pulleys is connected to a first vertical location of the frame. The counter-weight is connected to the harness via a cable traveling on the set of pulleys. The chin bar is connected to a second vertical location of the frame.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
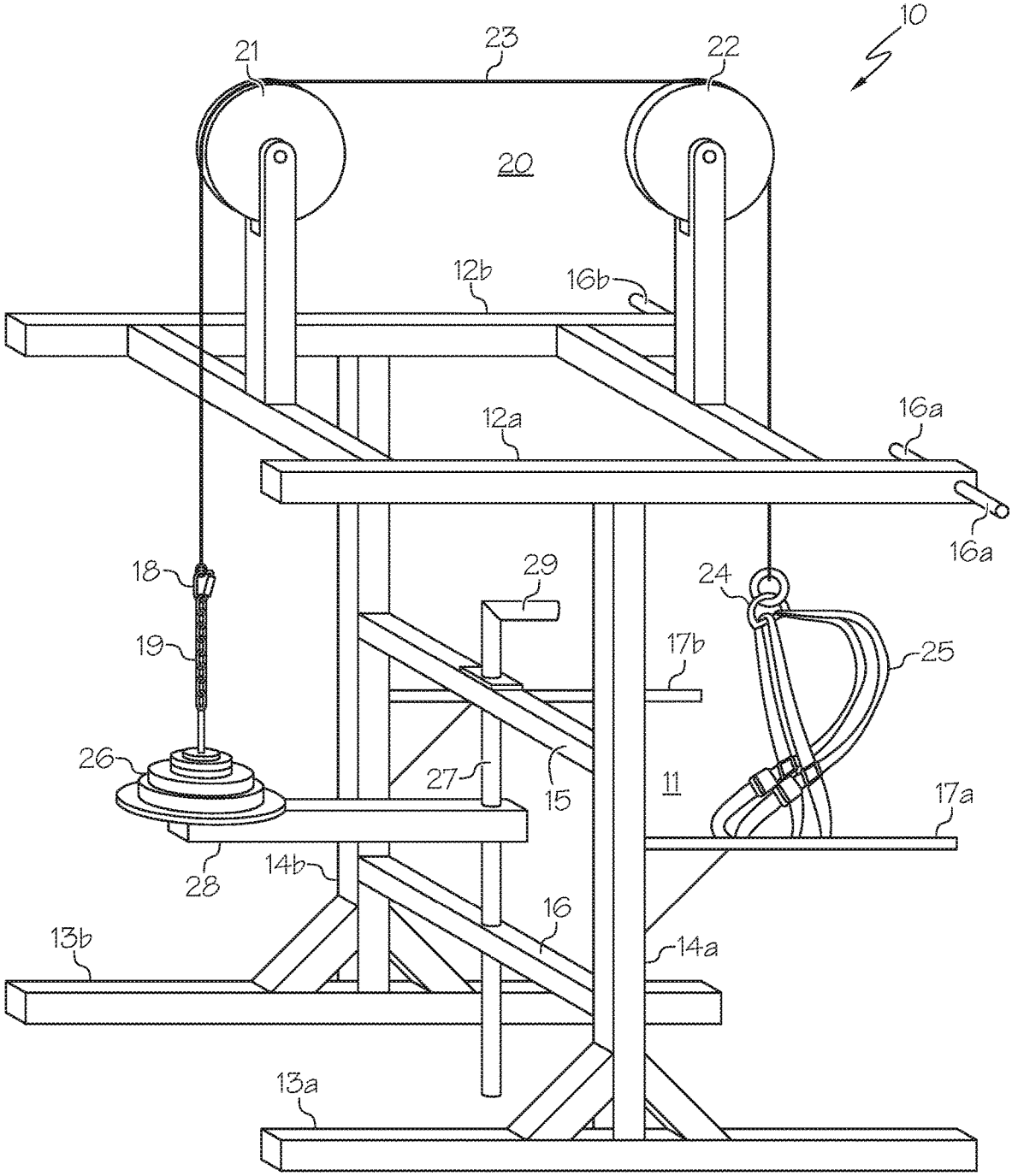
FIG. 1 is an isometric view of an exercise apparatus, according to one embodiment.
Figure 2:
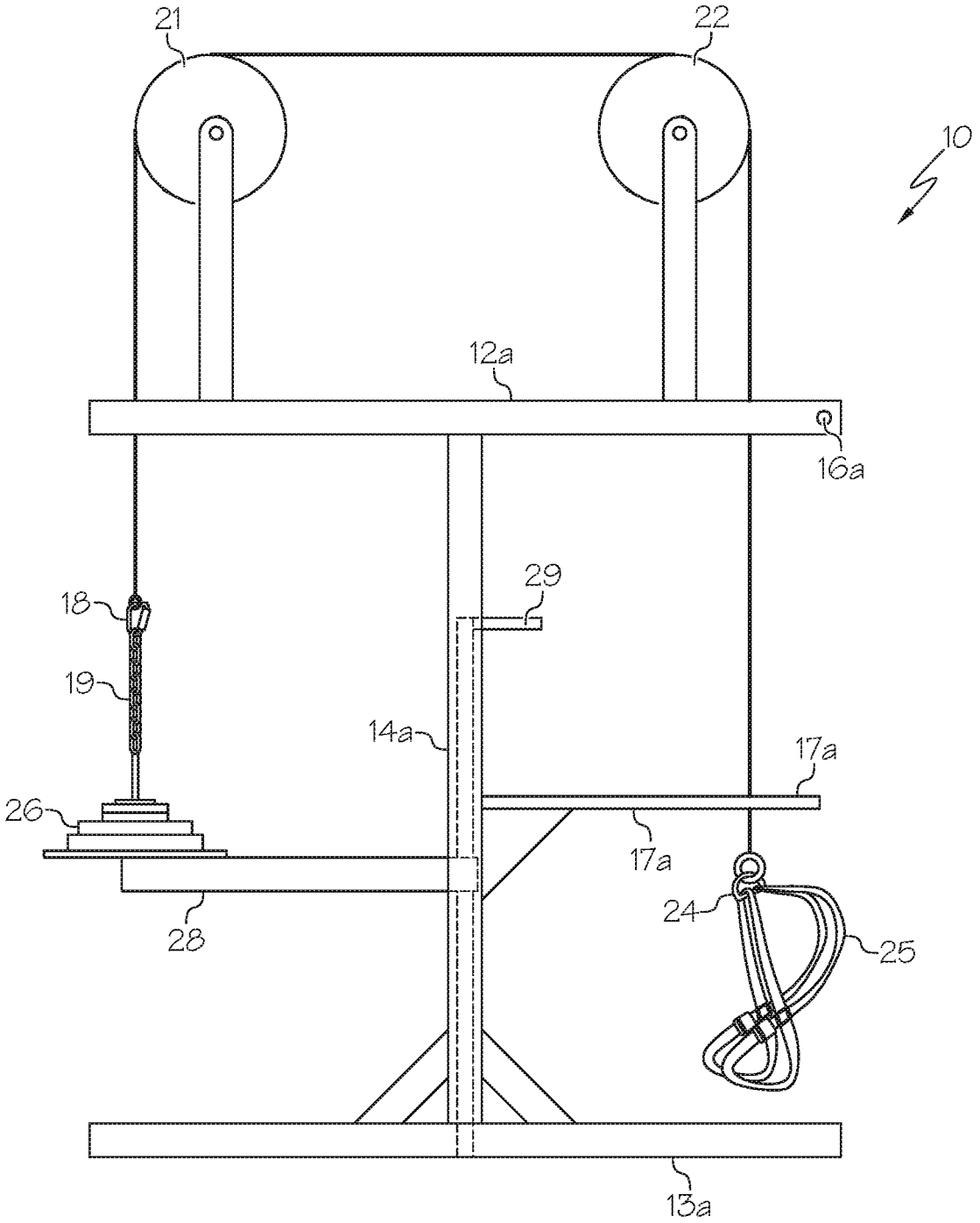
FIG. 2 is a side view of the exercise apparatus from FIG. 1.

Referring now to the drawings and in particular to FIGS. 1-2, there are illustrated an isometric and side views of an exercise apparatus, respectively, according to one embodiment. As shown, an exercise apparatus 10 includes a frame 11 and an overhead assist module 20. Frame 11 includes, for example, upper horizontal bars 12*a*, 12*b* and lower horizontal bars 13*a*, 13*b*. Upper horizontal bars 12*a*, 12*b* are connected to lower horizontal bars 13*a*, 13*b* via vertical bars 14*a*, 14*b*, respectively. Frame 11 is preferably constructed from tubular stock.

A chin bar having a pair of handles 16*a*, 16*b* is secured to upper horizontal bars 12*a*, 12*b*, respectively. The chin bar is configured for people to perform chin-up or pull-up exercises. Although the chin bar is shown to be formed by two bars spaced apart on frame 11, it is understood by those skilled in the art that the chin bar can be formed by one single bar.

Similarly, a dip bar having a pair of removable handles 17*a*, 17*b* is secured to vertical bars 14*a*, 14*b*, respectively. The dip bar is configured for people to perform dip exercises.

Overhead assist module 20 allows a person using exercise apparatus 10 to select a suitable positive upward force to assist him/her in doing chin-up, pull-up and/or dip exercises.

In the present embodiment, overhead assist module 20 includes two pulleys 21, 22, a harness 25, and a counter-weight 26. Pulleys 21, 22 are secured to upper horizontal bars 12*a*, 12*b*. Counter-weight 26 is connected to harness 25 via a chain 19 and a cable 23 traveling on pulleys 21, 22. Specifically, chain 19 is connected to cable 23 via a carabiner 18. In addition, cable 23 is connected to harness 25 at a ring, such as a D-ring 24. In order to quickly adjust the relative distance between harness 25 and handles 16*a*, 16*b* for accommodating the various heights of different users, carabiner 18 can be secured to any loop of chain 19 as needed. Although carabiner 18 and chain 19 are shown in the present embodiment, it is understand by those skilled in the art that any length adjustment mechanism can be used.

Counter-weight 26 may include, for example, five removable plates of 20 pounds each. Each 20-pound plate can be removed from the stack of counter-weight 26, which allows a user to select a counter weight assistance between 20 and 100 pounds. It is understood by those skilled in the art that the number of removable plates can be more or less than five, and that the weight of each removable plate can be more or less than 20 pounds.

When not in use, counter-weight 26 can be supported by a counter-weight stand 28 that is connected to a vertical rod 27. Vertical rod 27 can be secured to frame 11. For the present embodiment, vertical rod 27 goes through horizontal bars 15, 16 connected to vertical bars 14*a*, 14*b*. Vertical rod 27 can be freely rotated within horizontal bars 15, 16. Before doing any of chin-up, pull-up and/or dip exercises, a user having harness 25 strapped on (see FIGS. 3A-3B) can move counter-weight stand 28 away from counter-weight 26 by using a tiller 29 to rotate vertical rod 27 that is connected to counter-weight stand 28. As a result, the force of counterweight 26 (downward due to gravity) can be utilized to assist the user to do chin-ups, pull-ups, and/or dip exercises.

Figure 3A:
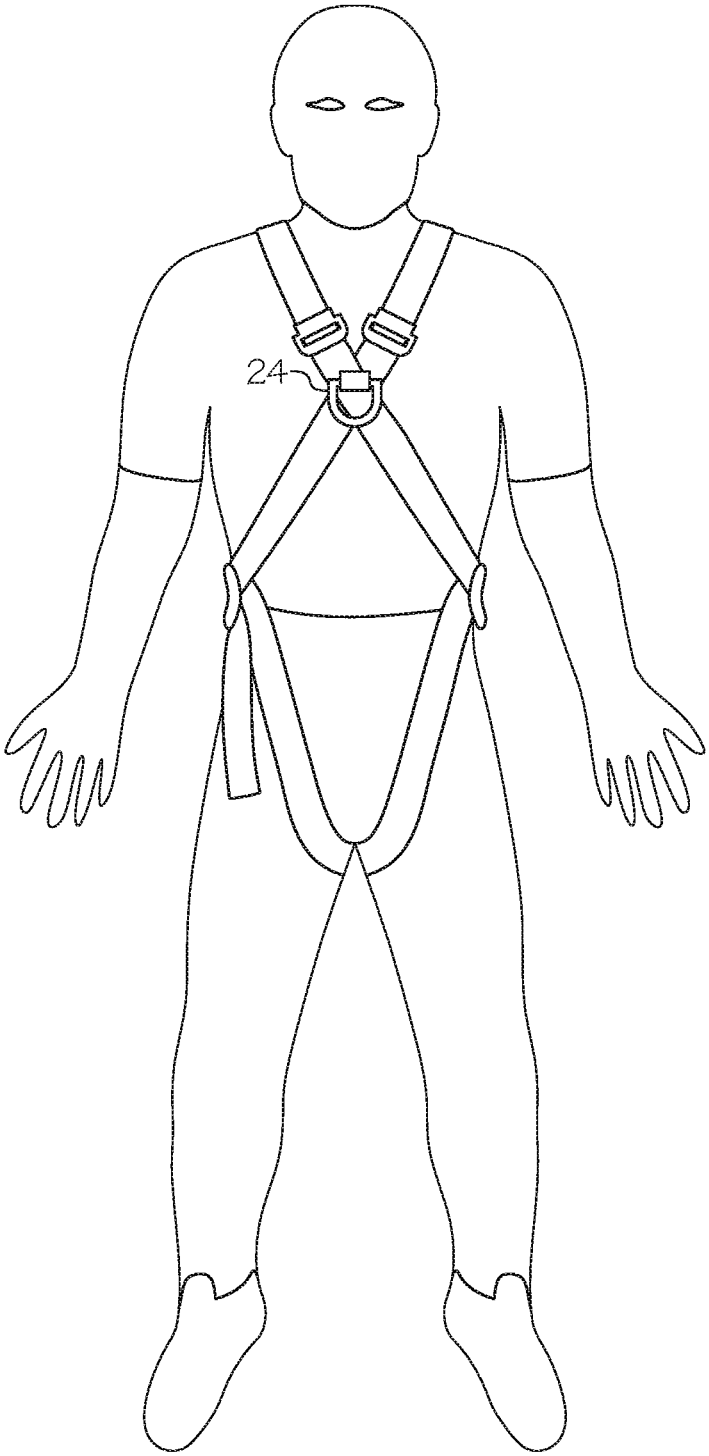
FIGS. 3A-3B are front and back views, respectively, of a user wearing a harness.
Figure 3B:
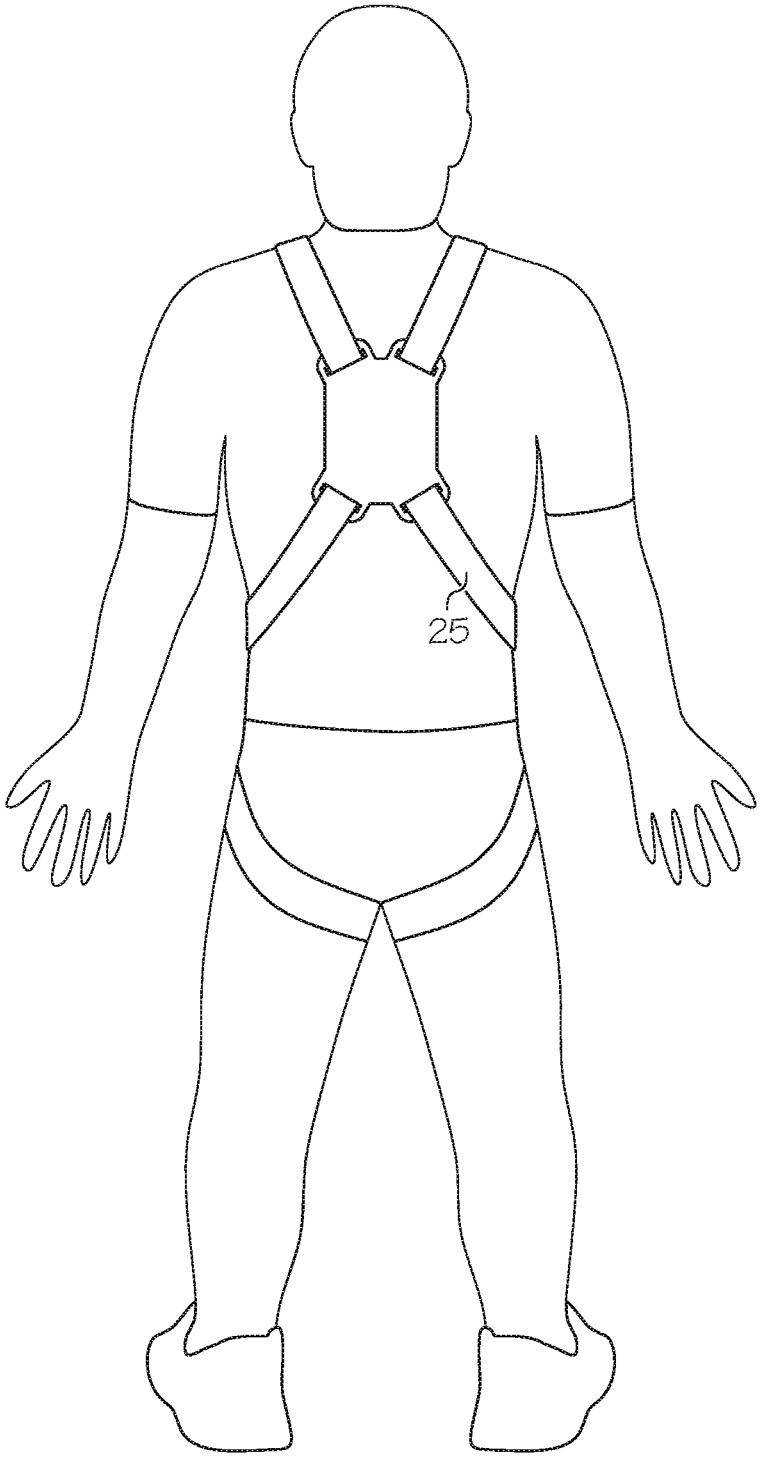

Referring now to FIGS. 3A-3B, there are illustrated isometric views of a user wearing harness 25. As shown, harness 25 is secured to the upper body and the hip area of a user. After harness 25 has been properly worn by a user, ring 24 should be positioned in the front body of the user, and substantially near the sternum of the user. This allows proper hoisting of the user via counter-weight 26 when the user is performing pull-up, chin-up and dips exercises.

Figure 4:
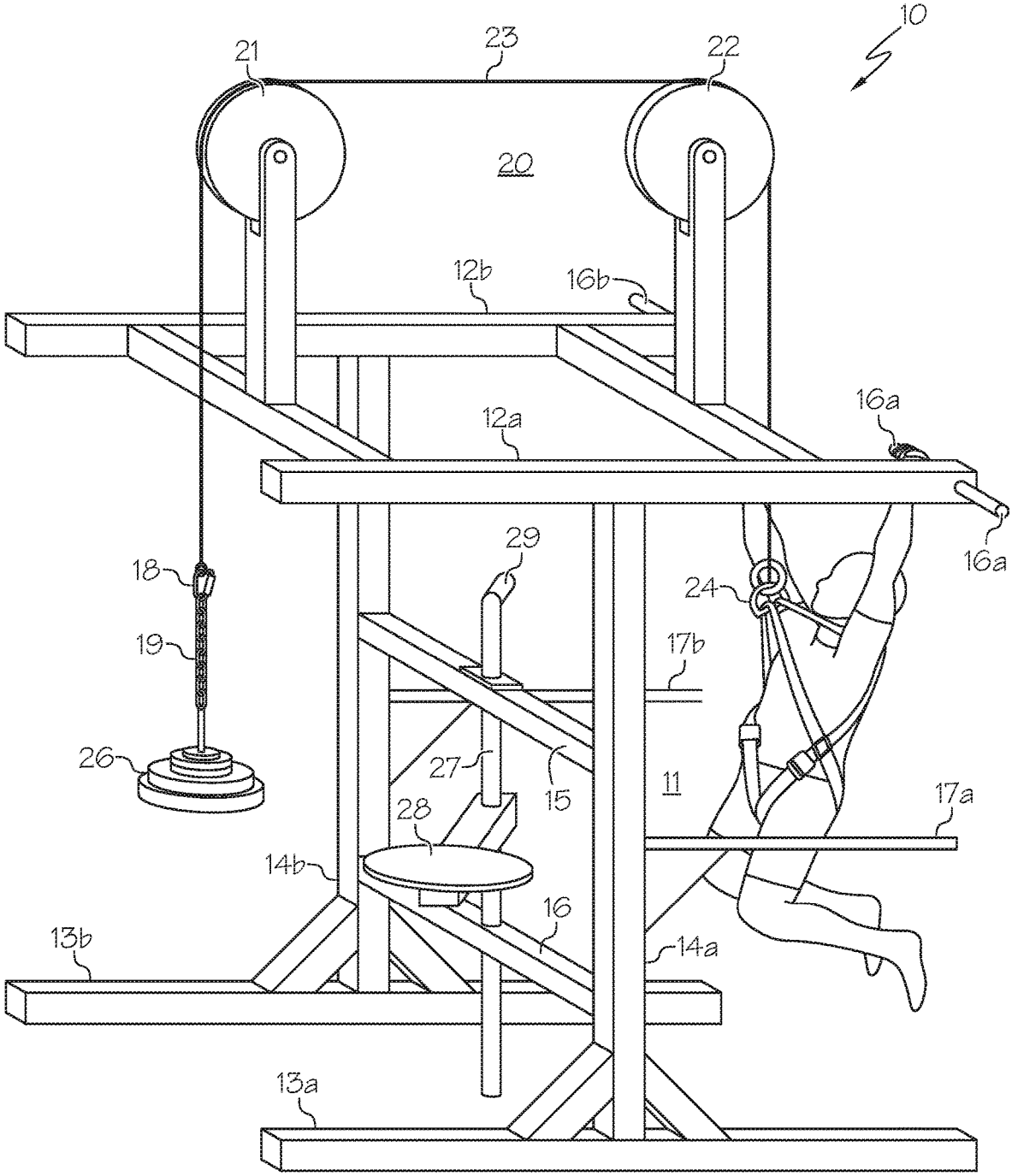
FIG. 4 illustrates a user doing pull-ups on the exercise apparatus from FIG. 1.

With reference now FIG. 4, there is illustrated a user doing pull-ups on exercise apparatus 10. It can be seen with overhead assist module 20 having sufficient counterweight 26, the user can be guaranteed the ability to raise his/her chin above the bar to perform a full extension pull-up/chin-up.

As has been described, the present invention provides an improved exercise apparatus for assisting people to do chin-ups, pull-ups, and/or dip exercises.

While the invention has been particularly shown and described with reference to a preferred embodiment, it will be understood by those skilled in the art that various changes in form and detail may be made therein without departing from the spirit and scope of the invention.

What is claimed is:

1. An exercise apparatus, comprising:

a frame;

an overhead assist module includes a set of pulleys connected to a first vertical location of said frame;

a harness;

a counter-weight connecting to said harness via a cable traveling on said set of pulleys; and a length adjustment mechanism connected between said cable and said counter-weight; and a chin bar connected to a second vertical location of said frame.

2. The exercise apparatus of claim 1, wherein said length adjustment mechanism includes a chain and a carabiner.

3. The exercise apparatus of claim 1, wherein said harness is a body harness that includes a ring to be positioned near the sternum of a user and to be pulled by said cable during exercise.

4. The exercise apparatus of claim 1, further comprising a dipping bar connected to a third location of said frame such that said dipping bar is positioned vertically below said chin bar.

5. The exercise apparatus of claim 1, further comprising a counter-weight stand for supporting said counter-weight.

6. The exercise apparatus of claim 5, further comprising said counter-weight stand is connected to a rod having a tiller.

* * * * *